United States Patent [19]

Fast

[11] Patent Number: 4,704,813

[45] Date of Patent: Nov. 10, 1987

[54] MULTIPURPOSE SIGN HOLDER

[76] Inventor: Jacob Fast, 7561 NW. 9th St., Plantation, Fla. 33317

[21] Appl. No.: 916,372

[22] Filed: Oct. 7, 1986

[51] Int. Cl.[4] ..... G09F 3/18

[52] U.S. Cl. ..... 40/11 R; 40/324

[58] Field of Search ..... 40/11 R, 324, 10 R, 40/124.4, 23 R

[56] References Cited

U.S. PATENT DOCUMENTS

| | | | |
|---|---|---|---|
| 1,261,447 | 4/1918 | Shuman | 40/10 R |
| 1,285,890 | 11/1918 | Anderson | 40/11 R |
| 1,483,408 | 2/1924 | Bernstein | 40/11 R |
| 1,757,440 | 5/1930 | Sharp | 40/11 R |
| 1,826,037 | 10/1931 | Allen | 40/324 |
| 2,564,517 | 8/1951 | Beals | 40/11 R |
| 2,924,900 | 2/1960 | Hoofer | 40/324 |
| 3,955,296 | 5/1976 | Kapstad | 40/11 R |
| 4,044,485 | 8/1977 | Hopp | 40/324 |

*Primary Examiner*—Gene Mancene
*Assistant Examiner*—Cary E. Stone
*Attorney, Agent, or Firm*—Holman & Stern

[57] ABSTRACT

A multipurpose display card holder is formed from a rectangular blank of plastic sheet. The blank is divided by three transverse crease lines into four contiguous panels namely a base forming panel at one end of the blank, a first card holder panel adjacent the base forming panel, a bridging panel adjacent the first card holder panel and a second card holder panel adjacent the bridging panel at the other end of the blank. The respective card holder panels are provided with card holder flaps opening toward the bridging panel. The first card holder panel is longer than the second card holder panel and the base forming panel is longer than the bridging panel. The blank is formed into a holder by folding the respective panels about the respective crease lines so as to form a resilient channel-like configuration defined by the card holder panels and bridging panel with the base forming panel folded at right angles under the channel-like configuration to form a foot for supporting the holder in a free standing manner. By resiliently deforming the panels from the folded configuration the channel-like portion of the holder can be engaged over the rim of a container such as a dish or bowl to support the holder thereon.

5 Claims, 9 Drawing Figures

MULTIPURPOSE SIGN HOLDER

BACKGROUND OF THE INVENTION

This invention relates to a multipurpose holder for display cards and the like, for example for holding cards containing product information in supermarkets and other stores, but which may find a variety of other uses such as for holding place-setting cards and the like.

In a delicatessen section of a supermarket, for example, bowls or trays of merchanidse are commonly provided with cards indicating their contents and price. Frequently such cards are mounted on metal clips attached to the rim of a bowl or tray and may tend to scratch the bowl or tray leading to an eventual source of contamination.

It is an object of the present invention to provide a novel and simplified form of holder for display cards and the like, which can be adapted to numerous card-holding applications, and which can, for example, be used as a free-standing card holder, or which can be attached to a variety of differently configured article containers, such as bowls, dishes, trays, wire baskets and the like, effectively to grip the container and retain a display card in a substantially secure and stable fashion substantially without damage to the container or the card.

SUMMARY OF THE INVENTION

The invention provides a card holder for the purpose indicated which is formed from a substantially rectangular blank of plastic sheet material, for example PVC sheet having a thickness of about 0.020 inch, a width of about 1 ½", and a length of about 2 ½". The blank is divided lengthwise by three transverse creases or bend lines into four contiguous panels. A first base-forming panel at one end of the blank may have a length of about ½", the next panel forming a first card holder panel, a length of about 1", the next panel forming a bridging panel, a length of about ¼", and the final panel forming a second card holder panel at the other end of the blank, a length of about ¾". The respective card holder panels are provided with cutouts defining respective card gripping flaps opening towards the bridging panel.

By suitably folding the blank about the respective creases, it can be adapted to a variety of card holding applications. For example, by folding the card holder panels and bridging panel into a right channel-like configuration, and folding the base-forming panel perpendicularly thereunder, the latter panel can form a foot on which the holder can be supported in a free-standing manner with the card holding flaps facing upwardly on opposite sides of the holder for selective receipt and frictional retention therein of a display card on either one or both sides of the holder.

From the free-standing configuration of the holder, the base-forming panel can be deformed somewhat downwardly allowing the channel-shaped portion of the holder resiliently to grip over the rim of a container with selective deformation of the holder as a whole to suite the particular shape of the container rim. The resilient nature of the holder enables it to be used on containers having a wide variety of rim shapes.

Holders in accordance with the invention are simple and economical to manufacture, adaptable to diverse uses, and being made of a plastic material, have a minimal tendency to damage articles on which they are used. Additional features and advantages of the invention will become apparent from the ensuing description and claims read in conjunction with the attached drawings.

DESCRIPTION OF PREFERRED EMBODIMENT

Figure 1:
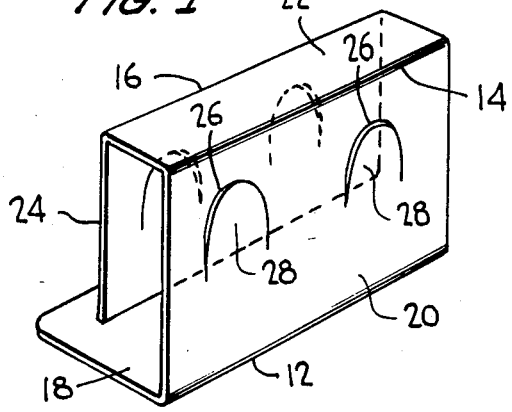
FIG. 1 is a perspective view of a display card holder in accordance with the invention.
Figure 2:
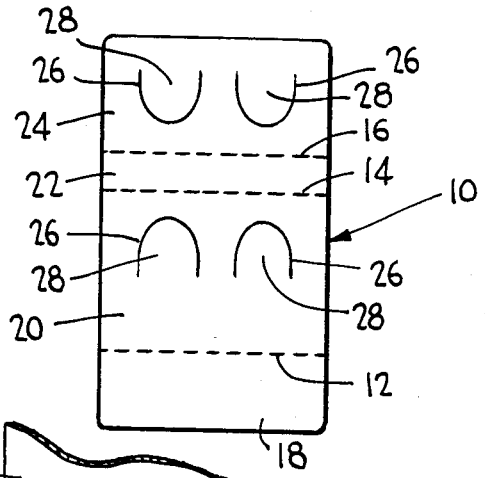
FIG. 2 is a reduced plan view of a blank for forming into the holder shown in FIG. 1.

Referring initially to FIG. 2, there is shown a blank 10 of rectangular PVC sheet as aforesaid, having first, second and third transverse creases 12, 14, 16 dividing the blank into a base-forming panel 18, a pair of card holder panels 20, 24, and a bridging panel 22. The respective card holder panels are each formed with a pair of arch-shaped cutouts 26 defining respective card holder flaps 28 opening toward the bridging panel.

Figure 4:
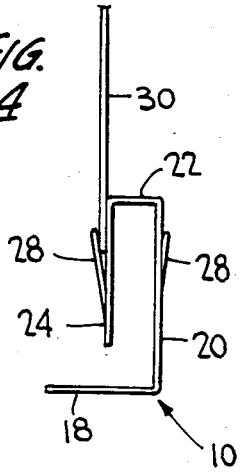
FIGS. 4 and 5 are elevational views of the holder showing display cards supported on opposited sides of the holder.
Figure 5:
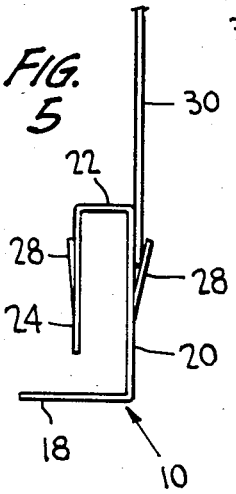
Figure 3:
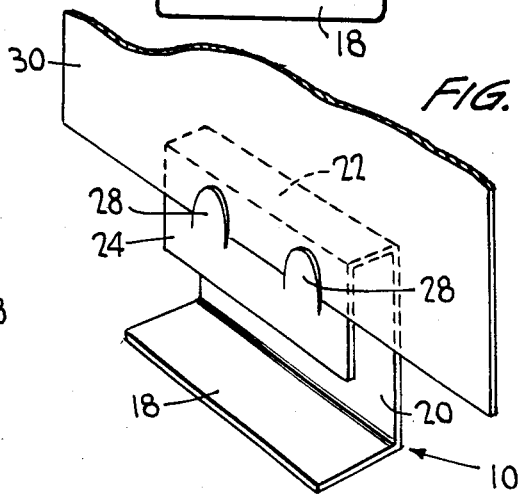
FIG. 3 is a view similar to FIG. 1 showing the holder supporting a display card on one side of the holder.

By suitably folding the blank about the respective creases, it can be formed into a holder configuration as shown in FIGS. 1, 3, 4 and 5 wherein the card holder panels 20, 24 and bridging panel 22 are formed into a downwardly opening channel-like shape, and base forming panel 18 is folded at right angles under the channel-like holder portion to form a foot for supporting the holder and enabling it to stand freely thereon. In this configuration of the holder, flaps 28 open upwardly so that sign or display cards 30 can be supported therein on either side of the holder as shown in FIGS. 4 and 5.

Figure 6:
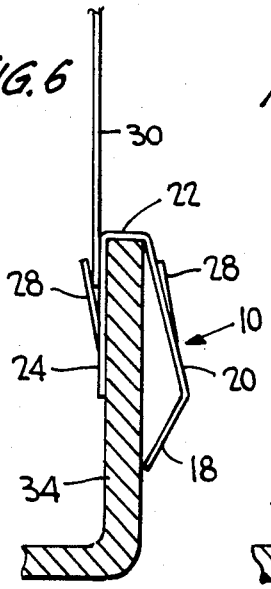
FIGS. 6, 7 and 8 are sectional elevational views of different shape dishes showing how the holder may be adapted to clip over their respective rims.
Figure 7:
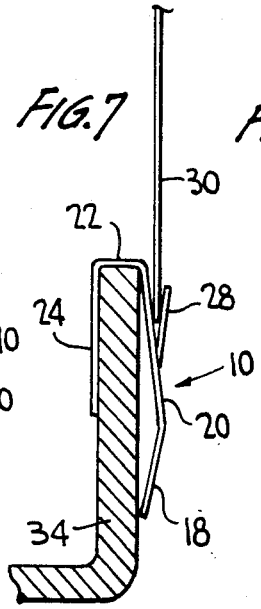
Figure 8:
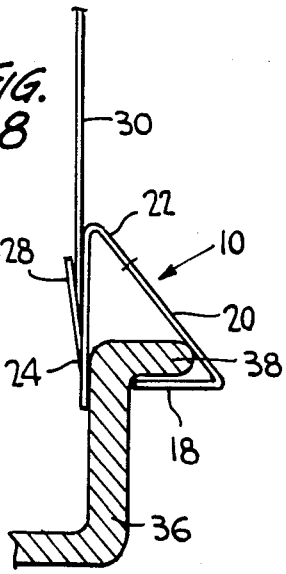
Figure 9:
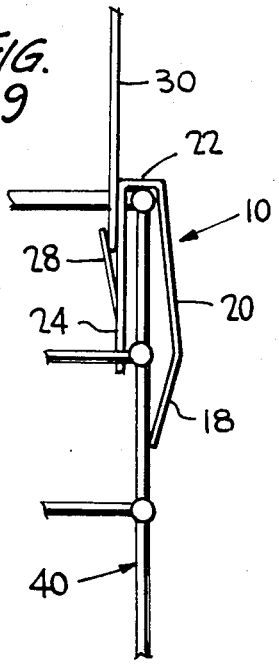
FIG. 9 is a sectional elevational view showing the holder attached to a wire basket.

The resiliency of the holder/blank 10 enables it to be somewhat resiliently deformed from the configuration shown in FIGS. 1, 3, 4 and 5 to the configurations shown in FIGS. 6–9 for attachment onto article containers of different shapes. Thus, in FIGS. 6 and 7, the channel portion of the holder is engaged over the rim of a plain bowl or dish 34 with base forming panel 18 deformed downwardly. Display card 30 can be inserted in the flaps 28 of either panel 20 or 24 dependent on whether the card is to be located inside or outside of the bowl, i.e as shown in FIG. 6 or FIG. 7 respectively. FIG. 8 shows how the holder may be resiliently deformed to grip on a bowl or dish 36 having a rim with an outwardly projecting flange 38. In this case, panels 20, 22 are deformed into a substantially coplanar orientation, and base-forming panel 18 engages under flange 38. Display card 30 is inserted in flaps 28 of panel 24 internally of the dish. FIG. 9 shows the holder attached to a wire basket 40 in similar manner to its attachment to bowl 34 in FIGS. 6 and 7. It will be understood that the holder can readily be restored to the configuration shown in FIGS. 1, 3, 4 and 5. Also, while the holder has been described as being folded from a blank of plastic sheet, it is quite conceivable that it could, for example, be molded in plastic for folding as previously described or molded in the configuration shown in FIGS. 1, 3, 4 and 5.

While only preferred embodiments of the inventio have been described herein in detail, the invention is not limited thereby and modifications can be made within the scope of the attached claims.

What is claimed is:

1. A holder for display cards which is formed of plastic sheet material configured to provide a pair of substantially parallel card holder panels, a bridging panel connecting the card holder panels into a channel-like configuration, a base-forming panel extending substantially perpendicularly from an edge of one of the card holder panels which is opposite the bridging panel and under the channel-like configuration to form a foot for supporting the holder in a free standing manner, and at least one card holder flap on at least one of the card holder panels opening towards the bridging panel, the holder being resiliently deformable for engaging the channel-like configuration over the rim of a container and the like.

2. A holder as defined in claim 1 including transverse creases between the respective panels about which the panels are folded to form the holder.

3. A holder as defined in claim 1 wherein there are a pair of the holder flaps on each of the card holder panels.

4. A substantially rectangular blank of plastic sheet material for forming into a display card holder, the blank including three transversely extending parallel crease lines dividing the blank into four contiguous panels including a base forming panel at one end of the blank, a first card holder panel adjacent the base forming panel, a bridging panel adjacent the first card holder panel and a second card holder panel at the other end of the blank, the blank further including at least one cutout in at least one of the card holder panels defining a flap opening towards the bridging panel, the first card holder panel being longer than the second card holder panel and the base forming panel being longer than the bridging panel.

5. A blank as defined in claim 4 including a pair of the cutouts in each of the card holder panels.

* * * * *